US011718428B2

(12) United States Patent
Graham et al.

(10) Patent No.: US 11,718,428 B2
(45) Date of Patent: Aug. 8, 2023

(54) METHODS AND MACHINE FOR PACKAGING PRIMARY CONTAINERS IN SECONDARY CONTAINERS AND A SHIPPING TRAY

(71) Applicant: WESTROCK SHARED SERVICES, LLC, Atlanta, GA (US)

(72) Inventors: Thomas Dean Graham, Winter Garden, FL (US); Amer Aganovic, Orlando, FL (US); Claudio D'Alesio, Windmere, FL (US); Michael F. Flagg, Newnan, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 306 days.

(21) Appl. No.: 17/066,036

(22) Filed: Oct. 8, 2020

(65) Prior Publication Data

US 2021/0024234 A1 Jan. 28, 2021

Related U.S. Application Data

(62) Division of application No. 15/793,272, filed on Oct. 25, 2017, now Pat. No. 10,829,250.

(Continued)

(51) Int. Cl.
*B65B 5/06* (2006.01)
*B65B 57/16* (2006.01)

(Continued)

(52) U.S. Cl.
CPC ..... *B65B 5/06* (2013.01); *B65B 5/024* (2013.01); *B65B 5/068* (2013.01); *B65B 21/14* (2013.01);

(Continued)

(58) Field of Classification Search
CPC ..... B65B 2220/16; B65B 21/04; B65B 21/14; B65B 5/06; B65B 5/068; B65B 57/00; B65B 57/16

(Continued)

(56) References Cited

U.S. PATENT DOCUMENTS 4,034,658 A * 7/1977 Sherman ..... B65H 5/062 493/177
4,704,841 A * 11/1987 Langenbeck ..... B65B 5/101 53/448

(Continued)

*Primary Examiner* — Valentin Neacsu
(74) *Attorney, Agent, or Firm* — Rohini K. Garg

(57) ABSTRACT

A machine for filling a tertiary container with secondary containers is provided. The machine includes a frame and a tray loading station positioned to receive a plurality of streams of the secondary containers. The machine also includes a front gate at an upstream end of the tray loading station, the front gate moveable between a first position, in which the secondary containers are obstructed from passing downstream, and a second position, in which the secondary containers are not obstructed. The machine further includes a back stop proximate a downstream end of the tray loading station, the back stop moveable between a first, upstream position and a second, downstream position. The tray loading station is sized such that when a first row of secondary containers is positioned against the back stop in the first position, a portion of an upstream row of secondary containers is positioned directly above the front gate.

12 Claims, 9 Drawing Sheets

Related U.S. Application Data

(60) Provisional application No. 62/415,166, filed on Oct. 31, 2016.

(51) Int. Cl.

| | |
|---|---|
| ***B65B 5/02*** | (2006.01) |
| ***B65B 21/14*** | (2006.01) |
| ***B65B 35/24*** | (2006.01) |
| ***B65B 57/00*** | (2006.01) |
| *B65B 21/04* | (2006.01) |

(52) U.S. Cl.
CPC ..... *B65B 35/24* (2013.01); *B65B 57/00* (2013.01); *B65B 57/16* (2013.01); *B65B 21/04* (2013.01); *B65B 2220/16* (2013.01)

(58) Field of Classification Search
USPC ..... 53/147, 235, 266.1; 198/418, 432
See application file for complete search history.

(56) References Cited

U.S. PATENT DOCUMENTS 4,856,263 A * 8/1989 Schneider ..... B65G 65/00 414/794.9
4,982,551 A * 1/1991 Nigrelli, Sr. ..... B65B 5/06 53/251
5,038,919 A * 8/1991 Harston ..... B65G 17/26 198/841
5,265,400 A * 11/1993 Roberts ..... B65B 7/20 53/529
5,501,318 A * 3/1996 Disrud ..... B65G 47/841 198/732
5,724,785 A * 3/1998 Malanowski ..... B65B 21/24 53/259
5,779,583 A * 7/1998 Nakatani ..... F16G 13/20 474/146
5,850,725 A * 12/1998 Chalendar ..... B65B 35/54 53/251
6,561,339 B1 * 5/2003 Olson ..... B07C 3/008 198/465.1
7,225,918 B2 * 6/2007 Freudelsperger .... B65G 17/002 198/817
8,783,447 B1 * 7/2014 Yohe ..... B65G 15/14 198/814
9,266,632 B1 * 2/2016 Anderson ..... B65B 61/02
9,409,367 B2 * 8/2016 Graham ..... B31B 50/006
10,196,162 B2 * 2/2019 Rasi ..... B65B 9/10
10,421,572 B2 * 9/2019 Moncrief ..... B65B 21/242
10,829,250 B2 * 11/2020 Graham ..... B65B 35/24
2006/0096243 A1 * 5/2006 Weaver ..... B65G 17/44 53/500
2010/0043355 A1 * 2/2010 Duperray ..... B65B 65/003 53/147
2011/0277420 A1 * 11/2011 Peters ..... B65G 17/20 198/339.1
2012/0011808 A1 * 1/2012 Langen ..... B65B 43/145 53/235
2012/0096808 A1 * 4/2012 Poutot ..... B65B 5/024 53/235
2012/0100976 A1 * 4/2012 Graham ..... B31B 50/00 414/795.4
2014/0024515 A1 * 1/2014 Wimmer ..... B65B 59/04 493/441
2014/0249008 A1 * 9/2014 Aganovic ..... B65D 5/003 493/167
2014/0311091 A1 * 10/2014 Moncrief ..... B65B 51/02 53/529
2015/0291295 A1 * 10/2015 Langen ..... B65B 5/06 53/376.4
2015/0329230 A1 * 11/2015 Rasi ..... B65B 5/06 53/147
2015/0329231 A1 * 11/2015 Moncrief ..... B65B 5/06 53/543
2015/0353212 A1 * 12/2015 Williamson ..... B65B 43/52 53/502
2017/0341873 A1 * 11/2017 Vivet ..... C12M 41/36
2017/0343993 A1 * 11/2017 Vivet ..... G01N 35/0092
2018/0118380 A1 * 5/2018 Graham ..... B65B 57/00
2018/0346164 A1 * 12/2018 Moncrief ..... B65B 5/024
2019/0359362 A1 * 11/2019 Moncrief ..... B65B 35/405
2020/0216203 A1 * 7/2020 Langen ..... B65B 7/24
2021/0024234 A1 * 1/2021 Graham ..... B65B 5/068

* cited by examiner

METHODS AND MACHINE FOR PACKAGING PRIMARY CONTAINERS IN SECONDARY CONTAINERS AND A SHIPPING TRAY

CROSS-REFERENCE TO RELATED APPLICATIONS

This application is a divisional application of U.S. patent application Ser. No. 15/793,272, filed on Oct. 25, 2017, which claims the benefit of priority under 35 U.S.C. § 119(e) to U.S. Provisional Application No. 62/415,166, filed on Oct. 31, 2016, each of which is hereby incorporated by reference in its entirety.

BACKGROUND

This disclosure relates generally to packaging primary containers within secondary containers and then packaging the secondary containers within a shipping tray, and more specifically to methods and a machine for forming a secondary container from a blank and placing primary containers, such as but not limited to cans or bottles, within the secondary containers and then packaging the secondary containers within a shipping tray.

Primary containers, such as but not limited to cans or bottles, are often packaged for retail display and sale in a secondary container, such as a folding carton that holds, for example, six cans or bottles in a 2×3 array or twelve cans or bottles in a 3×4 array. To form and fill such secondary containers, at least some known machines erect and convey the folding cartons along stationary rails. In some such machines, two side-by-side chains are positioned within each of the rails and include fingers that extend upwardly above the top of the rails to push the cartons along the rails. However, the force required to push a large number of cartons along the rails necessitates that the chains be relatively large, which limits how closely the rails can be spaced from each other. In other words, the size of the chains required and the position of the chains inside the rail require the rail spacing to be large and thus, such known systems are restricted to operating with containers that have at least a minimum width. Thus, an ability to erect and convey a carton having a narrow dimension transverse to the rails, such as but not limited to a carton sized to hold two primary containers in a row transverse to the rail direction (e.g., a 2×2 arrangement of cans or bottles) is limited.

In addition, a plurality of secondary containers may be packed in a tray for shipping and storage. For example, but not by way of limitation, a machine arranges four filled secondary containers in a 2×2 array in a tray formed from a corrugated blank, and the filled tray is shrink-wrapped. However, a speed of at least some known machines is limited by a need to accumulate, at the tray loading station, the correct number and arrangement of secondary containers from the secondary container loading station. These known systems are unable to continuously feed secondary containers to a tray loading station without accumulating excess secondary containers in some way before feeding them to the tray loading station. The need for accumulation typically requires numerous additional conveyors or other devices, which increases an expense, weight, and footprint size of these machines. These machines are also unable to feed the tray loading station on demand.

BRIEF DESCRIPTION

In one embodiment, a machine for filling a secondary container with a plurality of primary containers is provided.

The machine includes a frame, a secondary container filling section coupled to the frame and configured to position the primary containers within the secondary container, and a first rail member coupled to the frame. The first rail member includes at least one chain, a support rail that extends in a longitudinal direction between a supply source of secondary containers and the secondary container filling section, and at least one longitudinally extending interface surface coupled to the support rail and configured to receive the at least one chain, such that the at least one chain is movable in the longitudinal direction. The first rail member also includes an articulated chain cover secured to, and movable with, the at least one chain, the articulated chain cover defining a support surface on which the secondary containers are conveyable between the supply source and the secondary container filling section.

In another embodiment, a machine for filling a tertiary container with a plurality of secondary containers is provided. The machine includes a frame, and a tray loading station coupled to the frame and positioned to receive a plurality of streams of the secondary containers from an upstream direction. The machine also includes a front gate positioned at an upstream end of the tray loading station. The front gate is selectively moveable between a first position, in which the secondary containers are obstructed from passing downstream to the tray loading station, and a second position, in which the secondary containers are not obstructed from passing downstream to the tray loading station. The machine further includes a back stop proximate a downstream end of the tray loading station. The back stop is selectively moveable between a first, upstream position and a second, downstream position. The tray loading station is sized such that when a first row of secondary containers is positioned against the back stop positioned in the first position, a portion of an upstream row of secondary containers is positioned directly above the front gate.

DETAILED DESCRIPTION

Figure 1:
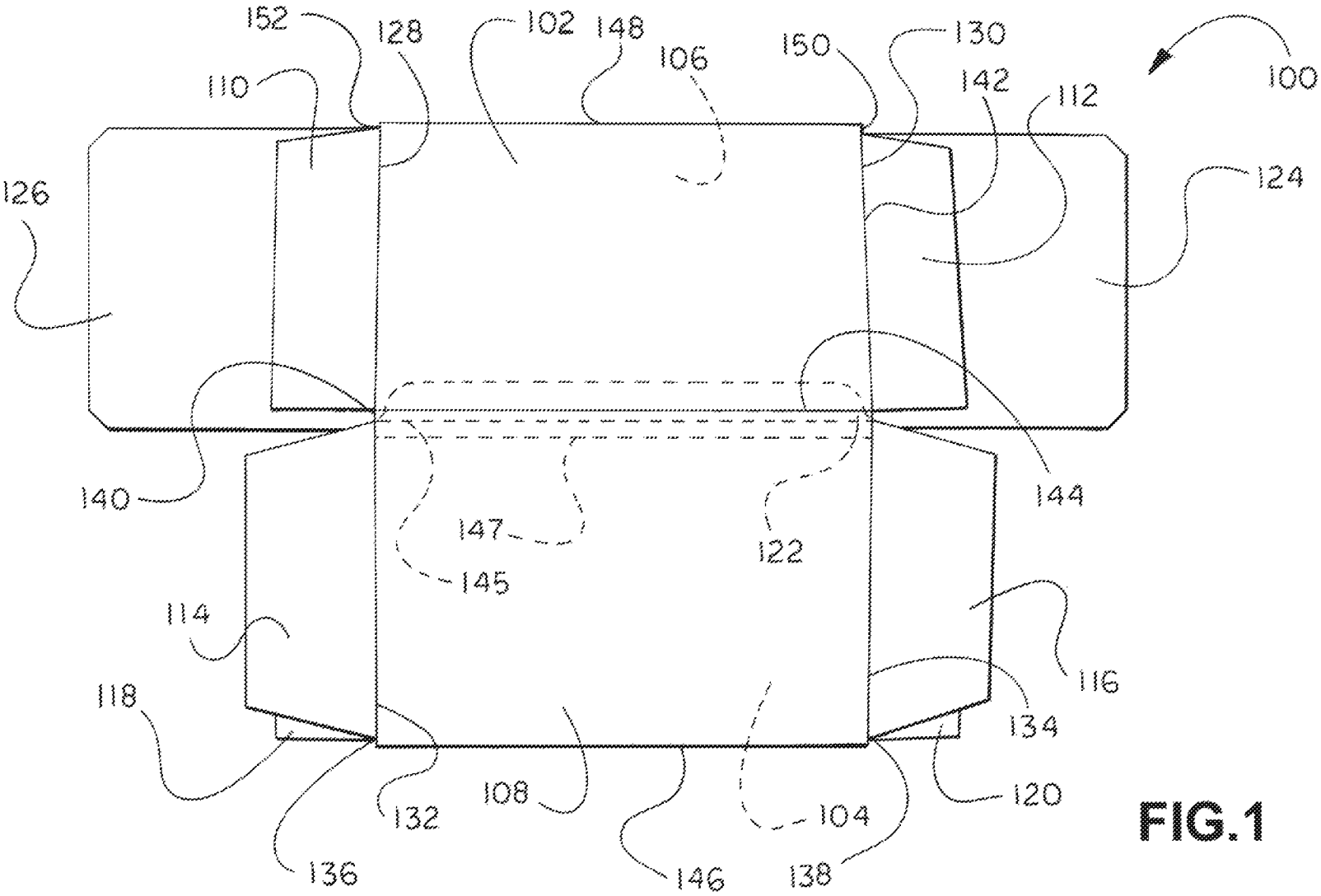
FIG. 1 is a top plan view of an example embodiment of a knocked down flat blank of sheet material that may be used with the machine described herein for forming a secondary container.

In the manufacturing industry, manufacturers strive to decrease both product production timing and manufacturing costs to keep up with consumer demand and increase net profit. There are a number of ways manufacturers can decrease production and packaging timing, and most of them involve mass production techniques using assembly line machinery. Unfortunately, assembly line machinery can be large, inconvenient, and costly to run.

The disclosure described herein provides a product packaging machine suitable for an assembly line. The machine uses a dual rail conveyor system and an on-demand product loading system to both decrease a footprint of the machine and decrease a time of non-movement of the product through the machine. Because the tray loading station is fed in an on-demand fashion, that is, as soon as the required number of filled secondary containers have arrived for loading in the tray, the machine does not require accumulation of excess product in order to feed the tray loading station.

The methods and machine for forming containers as described herein overcome at least some of the limitations of known container-forming machines. The machine includes a secondary container erecting section for retrieving and erecting a folding carton blank. The secondary container erecting section includes dual chains coupled to an upper surface of each rail member. The secondary containers ride directly on an articulable chain cover that is secured to, and moves with, each chain. The embodiments provided herein facilitate the use of smaller chains positioned on top of the rails, which allows the two rail members to be placed closer together, as compared to previous systems, to support containers having a smaller dimension transverse to the rail members. More specifically, the present disclosure facilitates placing a plurality of primary containers, such as but not limited to cans or bottles, into a secondary container in, for example, a 2×2, 2×4, or 2×6 array.

In some embodiments, the machine also includes a secondary container arranging section that arranges the filled secondary containers in a selected configuration for loading into a tertiary container, such as a corrugated shipping tray. The secondary container arranging section conveys filled secondary containers to a tray pre-loading station adjacent a front gate of a tray loading station. Each of the pre-loading and loading stations includes a continuously operated downstream conveying surface, and a front gate is positioned between the conveying surfaces. In addition, the loading station includes an indexed back stop that is moveable between a first, upstream position and a second, downstream position. When the arrangement of filled secondary containers is completed at the pre-loading station, the front gate is retracted below a level of a receiving surface of the loading station, such that the completed arrangement of secondary containers is conveyed into the loading station. In the first, upstream position, the back stop receives and positions the secondary containers such that the last row of containers in the arrangement is positioned over the retracted front gate. The front gate is then extended above the receiving surface level of the tray loading station, such that the last row of containers in the array is slightly elevated. The back stop then moves to the second, downstream position, such that the last row of secondary containers in the array is conveyed beyond the extended front gate. The extended front gate prevents any succeeding containers from reaching the loading station before the received arrangement is moved to the tray. By initially stopping the first row of containers such that the last row is on the front gate, the arrangement to be loaded on the tray is effectively separated from any successively arriving secondary containers without any need to stop the conveying surfaces of the pre-loading or loading stations, and without a need for a precisely located and timed separator for the last row of the arrangement. A transverse pusher sweeps the array of secondary containers onto the tray, and the indexed back stop is returned to the first position to repeat the process. The indexed back stop, retractable front gate, and continuously operated conveying surfaces of the pre-loading and loading stations thus provide on-demand loading of secondary containers into the tertiary container, without any need to buffer excess secondary containers, and without any need to stop and start the secondary container conveyors.

The machine described herein is configurable to form one or more types of secondary container and, in some embodiments, one or more types of tertiary container. The secondary container may have, for example, a different depth, a different lid configuration, and/or a different printing on an outer surface. Similarly, the tertiary container may have, for example, a different depth, a different lid configuration, and/or a different printing on an outer surface.

Figure 2:
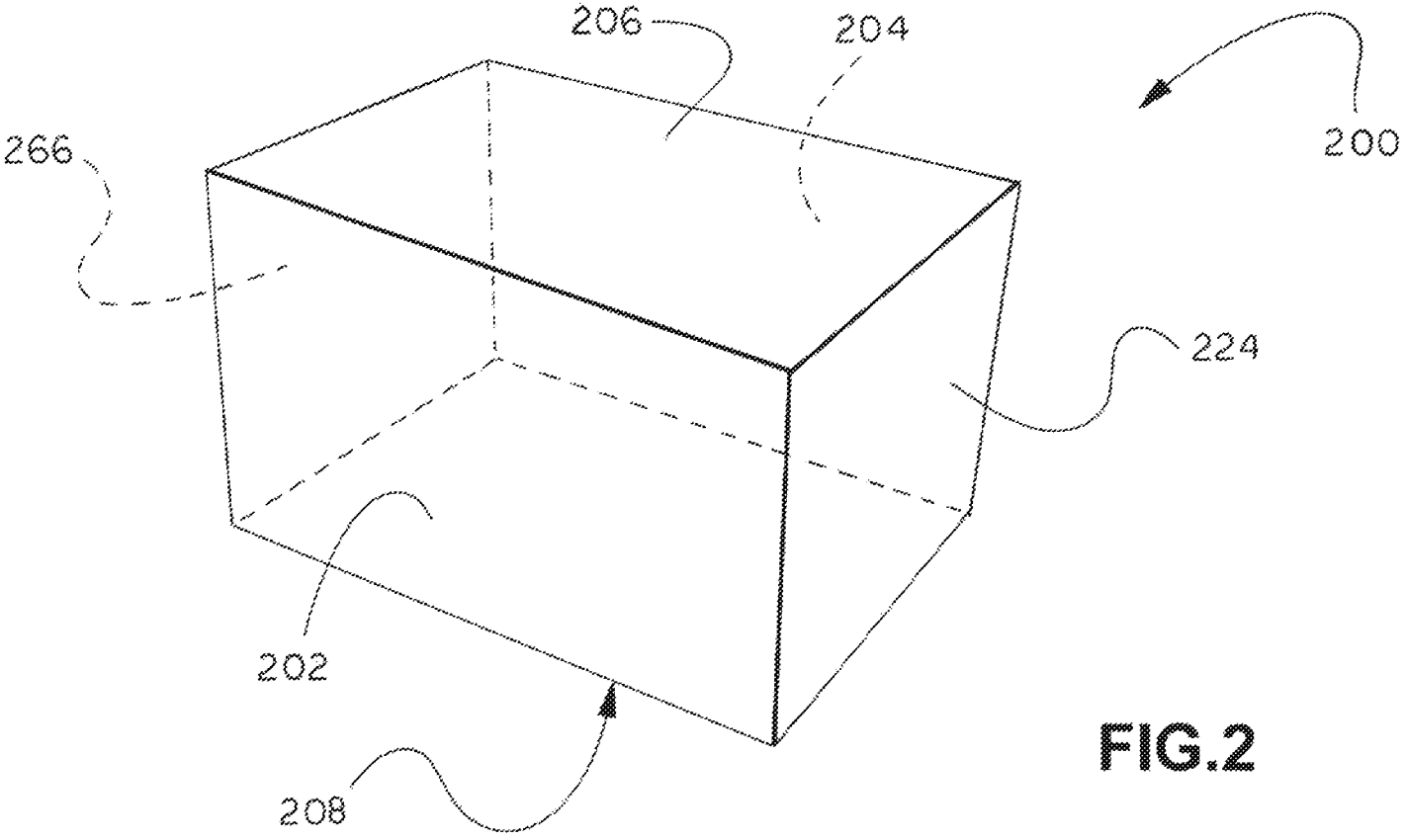
FIG. 2 is a schematic perspective view of an example embodiment of a secondary container formed from the blank shown in FIG. 1.

FIG. 1 illustrates a top plan view of an example embodiment of a knock-down flat ("KDF") blank 100 of sheet material. FIG. 2 illustrates a schematic perspective view of an example embodiment of a secondary container 200 formed from KDF blank 100. In the example embodiment, KDF blank 100 is formed from at least one of paperboard, corrugated board, cardboard, and plastic. In alternative embodiments, KDF blank 100 is formed from any suitable material that enables secondary container 200 to be formed, and to function, as described herein. In certain embodiments, portions of KDF blank 100 include printed graphics, such as advertising and/or promotional materials.

In the example embodiment, KDF blank 100 includes a plurality of side panels connected in series along a plurality of generally fold lines. More specifically, KDF blank 100 includes, in series from a leading edge 144, a first side panel 102, a top panel 106 extending from first side panel 102 along fold line 148, a second side panel 104 extending from top panel 106 along fold line 145, a bottom panel 108 extending from second side panel 104 along fold line 146, and a glue panel 122 extending from bottom panel 108 along fold line 147. Moreover, glue panel 122 is coupled to first side panel 102 to form a manufacturer's joint, such that first side panel 102 is in a face-face overlying relationship with top panel 106, and bottom panel 108 is in a face-face overlying relationship with second side panel 104. In alternative embodiments, glue panel 122 extends from first side panel 102 and is coupled to bottom panel 108. Although certain elements are designated as "top" and "bottom," these terms are used solely for ease of description and should not be understood to constrain an orientation of KDF blank 100 or secondary container 200.

KDF blank 100 also includes a plurality of end flaps 110, 112, 114, 116, 118, 120, 124, and 126 connected to respective side panels 102, 104, 106, and 108 by a plurality of preformed, generally parallel, fold lines defined generally perpendicular to fold lines 145, 146, 147, and 148. More specifically, end flaps 110 and 112 extend from opposite sides of first side panel 102 along respective fold lines 128 and fold line 130, end flaps 114 and 116 extend from opposite sides of bottom panel 108 along respective fold lines 132 and 134, end flaps 118 and 120 extend from opposite sides of second side panel 104 along respective fold lines 136 and 138, and end flaps 124 and 126 extend from opposite sides of top panel 106 along respective fold lines 150 and 152.

To form secondary container 200 from KDF blank 100, first side panel 102 is urged away from top panel 106, and/or bottom panel 108 is urged away from second side panel 106, such that top and bottom panels 106 and 108 are oriented parallel to each other and orthogonal to first and second side panels 102 and 104. Top and bottom panels 106 and 108 form top and bottom walls 206 and 208, respectively, of secondary container 200. First side panel 102 and glue panel 122 cooperate to form first side wall 202 of secondary container 200, and second side panel 104 forms second side wall 204 of secondary container 200.

In addition, end flaps 112, 116, 120, and 124 are folded inward into an orientation parallel with each other and orthogonal to walls 202, 204, 206, and 208, and coupled together to form a first end wall 224 of secondary container 200. For example, but not by way of limitation, glue is applied to at least one of end flaps 112, 116, 120, and 124 to facilitate coupling to others of end flaps 112, 116, 120, and 124. Similarly, end flaps 110, 114, 118, and 126 are folded inward into an orientation parallel with each other and orthogonal to walls 202, 204, 206, and 208, and coupled together to form a second end wall 226 of secondary container 200. For example, but not by way of limitation, glue is applied to at least one of end flaps 110, 114, 118, and 126 to facilitate coupling to others of end flaps 110, 114, 118, and 126.

Of course, blanks having shapes, sizes, and configurations different from KDF blank 100 as described and illustrated herein may be used to form secondary container 200 without departing from the scope of the present disclosure. In other words, machine 1000 (shown in FIG. 3) and associated processes described herein can be used to form a variety of different shaped and sized containers, and are not limited to use with KDF blank 100 shown in FIG. 1 and/or secondary container 200 shown in FIG. 2. For example, secondary container 200 is shown as a container with four side walls, but could be a six-sided container, an eight-sided container, or an N-sided container without departing from the scope of this disclosure.

Figure 3:
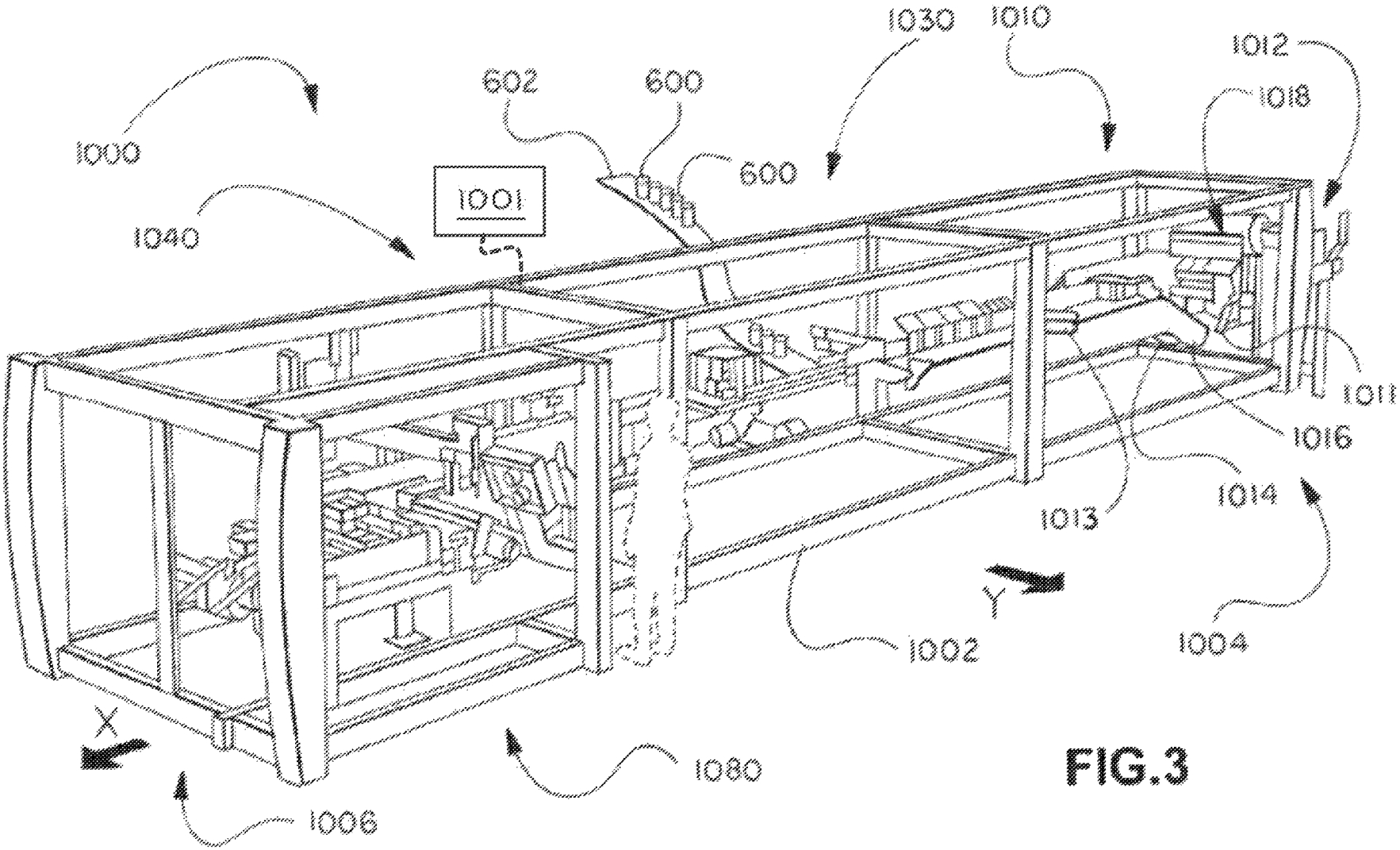
FIG. 3 is a schematic diagram of an example embodiment of a machine for forming the secondary container shown in FIG. 2 from the blank shown in FIG. 1, and for placing primary containers therewithin.

FIG. 3 is a schematic diagram of an example embodiment of a machine 1000 for forming secondary container 200 from KDF blank 100 and placing primary containers 600, such as but not limited to cans or bottles, therewithin. Machine 1000 includes a plurality of sections coupled to a frame 1002. More specifically, machine 1000 includes, from an upstream end 1004 to a downstream end 1006 along a longitudinal direction X, a secondary container erecting section 1010, a secondary container filling section 1030, a secondary container arranging section 1040, and a tertiary container filling section 1080. In alternative embodiments, machine 1000 includes any other suitable combination and arrangement of sections that enables machine 1000 to function as described herein.

In the example embodiment, machine 1000 includes a computer-implemented controller 1001 operatively coupled to various actuators and sensors of machine 1000, as will be described herein. For example, controller 1001 includes one or more processors or processing units, system memory, and is programmable via some form of tangible and non-transitory computer readable media. More specifically, controller 1001 is operable to automatically control, for example, at least one of an activation/deactivation timing, a speed of movement, and a direction of movement of each actuator based on at least one of a feedback signal from the sensors and a set of pre-programmed instructions. In certain embodiments, a use of controller 1001 increases a speed and/or accuracy of operation of machine 1000. In alternative embodiments, machine 1000 does not include computer-implemented controller 1001.

Secondary container erecting section 1010 includes a suitable supply source 1012 of KDF blanks 100 suitably positioned relative to frame 1002. In the example embodiment, supply source 1012 includes a hopper in which KDF blanks 100 are stacked in a selected orientation in face-to-face relationship. In alternative embodiments, supply source 1012 includes any other suitable structure that enables secondary container erecting section 1010 to function as described herein.

In the example embodiment, secondary container erecting section 1010 also includes a first rail member 1014 and a second rail member 1016 coupled to frame 1002. First rail member 1014 and second rail member 1016 are configured to convey KDF blank 100 downstream towards secondary container filling section 1030, as will be described below, as KDF blank 100 is erected into secondary container 200. In alternative embodiments, secondary container erecting section 1010 includes any other suitable structure for conveying KDF blank 100 and/or secondary container erecting section 1010 downstream towards secondary container filling section 1030 that enables secondary container erecting section 1010 to function as described herein.

In the example embodiment, secondary container erecting section 1010 further includes a transfer mechanism 1018 coupled to frame 1002 and operable to transfer each KDF blank 100 from supply source 1012 to rail members 1014 and 1016. More specifically, in the example embodiment, transfer mechanism 1018 includes a plurality of selectively activatable vacuum elements (not numbered). Transfer mechanism 1018 is movable between a first position proximate supply source 1012, wherein the activated vacuum elements contact and securely couple to a first KDF blank 100 positioned on supply source 1012, and a second position proximate rail members 1014 and 1016, wherein the vacuum elements are deactivated to release KDF blank 100 onto rail members 1014 and 1016. In certain embodiments, movement of transfer mechanism 1018 and/or activation of the vacuum elements is automatically controlled by controller 1001, as described above. In alternative embodiments, transfer mechanism 1018 includes any other suitable structure that enables secondary container erecting section 1010 to function as described herein.

In the example embodiment, secondary container erecting section 1010 also includes a flap guide 1011 oriented to engage at least one of end flaps 110, 112, 114, 116, 118, 120, 124, and 126 (shown in FIG. 1) as KDF blank 100 is transferred to rail members 1014 and 1016, such that secondary container 200 is at least partially formed from KDF blank 100. More specifically, flap guide 1011 engages at least one of end flaps 110, 112, 114, 116, 118, 120, 124, and 126 such that first side panel 102 is urged away from top panel 106, and/or bottom panel 108 is urged away from second side panel 106, such that top and bottom walls 206 and 208 and first and second side walls 202 and 204 of secondary container 200 (shown in FIG. 2) are formed. In alternative embodiments, secondary container erecting section 1010 includes any suitable structure for urging first side panel 102 away from top panel 106, and/or urging bottom panel 108 away from second side panel 106, to form walls 202, 204, 206, and 208 of secondary container 200.

Further in the example embodiment, secondary container erecting section 1010 includes a suitable first end flap folder/gluer assembly 1013 coupled to frame 1002 adjacent second rail member 1016 downstream from transfer mechanism 1018. First end flap folder/gluer assembly 1013 is operable to form first end wall 224 from end flaps 112, 116, 120, and 124 of partially erected KDF blank 100, as described above. In alternative embodiments, first end flap folder/gluer assembly 1013 coupled to frame 1002 adjacent first rail member 1014 and is operable to form second end wall 226 from end flaps 110, 114, 118, and 126. In some such embodiments, flap guide 1011 extends along rail member 1016 between transfer mechanism 1018 and first end flap folder/gluer assembly 1013 to facilitate maintaining walls 202, 204, 206, and 208 of secondary container 200 in the erected configuration until one of first and second end walls 224 and 226 is securely formed. In alternative embodiments, secondary container erecting section 1010 includes any suitable structure for forming one of first and second end walls 224 and 226 of secondary container 200.

Figure 4:
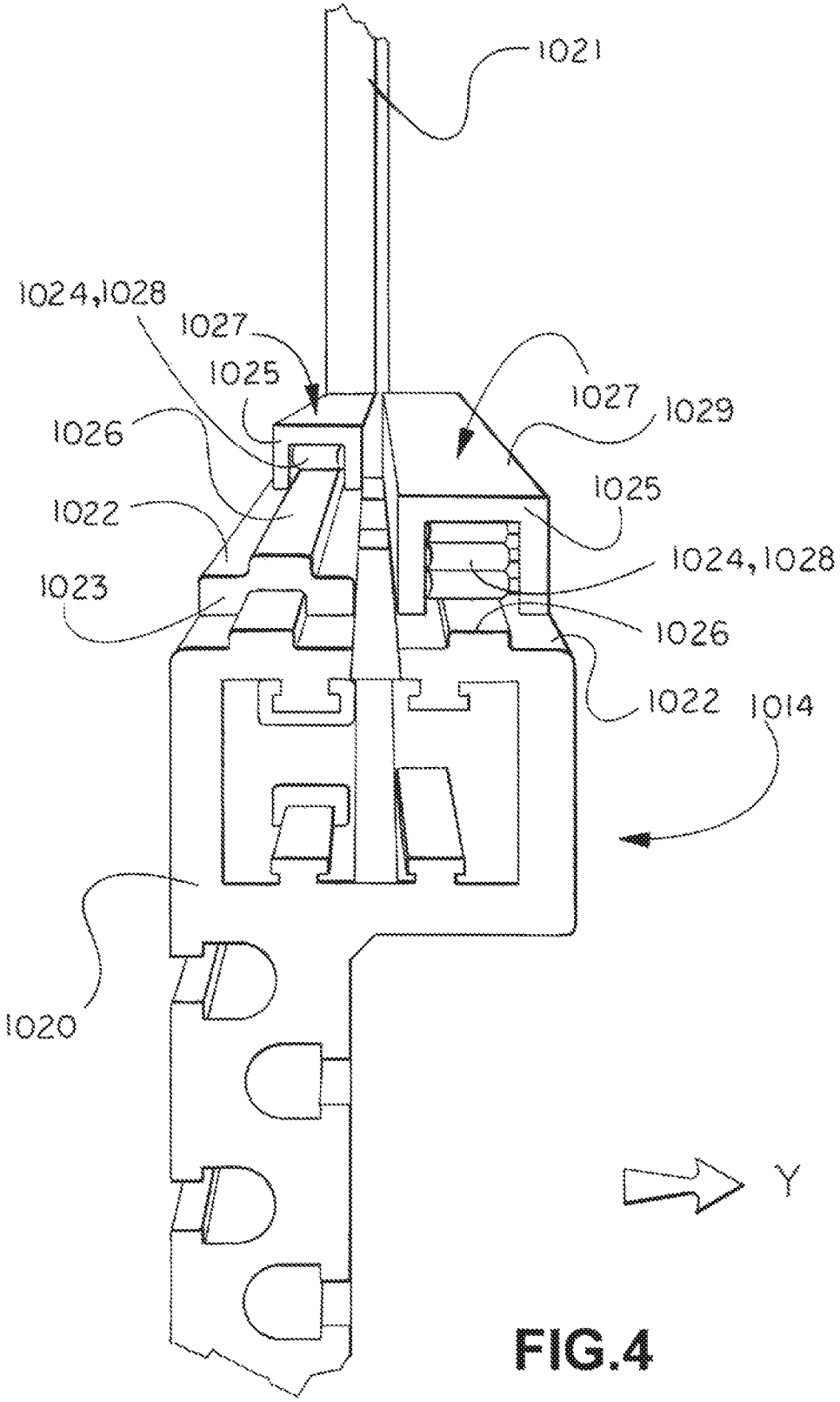
FIG. 4 is a schematic cutaway view of an example embodiment of a first rail member of the machine shown in FIG. 3.

FIG. 4 is a schematic cutaway view of an example embodiment of first rail member 1014, from a perspective viewed downstream along longitudinal direction X. In the example embodiment, first rail member 1014 includes a support rail 1020 that extends longitudinally between supply source 1012 and secondary container filling section 1030. In the example embodiment, support rail 1020 is formed from a metal material and has a cross-sectional shape selected to provide strength and rigidity to first rail member 1014. In alternative embodiments, support rail 1020 is formed from any suitable material, and has any suitable shape, that enables first rail member 1014 to function as described herein.

First rail member 1014 also includes at least one longitudinally extending interface surface 1022 coupled to support rail 1020 and configured to receive a respective chain 1024. More specifically, interface surface 1022 is configured to permit movement of chain 1024 in longitudinal direction X, and constrain chain 1024 against movement in transverse direction Y. In the example embodiment, interface surface 1022 includes a longitudinally extending track 1026 having a width, in transverse direction Y, that is sized to be received between edges of each link 1028 of chain 1024 in a clearance fit. In alternative embodiments, interface surface 1022 has any suitable shape that enables first rail member 1014 to function as described herein.

In the example embodiment, first rail member 1014 includes two interface surfaces 1022 and two corresponding chains 1024. In alternative embodiments, first rail member 1014 includes any suitable number of interface surfaces 1022 and corresponding chains 1024 that enables secondary container erecting section 1010 to function as described herein. In certain embodiments, the number of chains for each of rail members 1014 and 1016 is selected to provide a suitable width of a support surface 1027 on which each secondary container 200 is positioned, as will be described further herein.

In certain embodiments, as shown for the right-hand interface surface 1022 in the view of FIG. 4, interface surface 1022 is defined directly by support rail 1020. For example, interface surface 1022 is formed integrally with support rail 1020. In other embodiments, as shown for the left-hand interface surface 1022 in the view of FIG. 4, interface surface 1022 is defined by a wear member 1023 coupled to support rail 1020. For example, wear member 1023 is formed from a plastic material that provides a lower-friction interface with chain 1024, as compared to a material used to form support rail 1020, thereby increasing an operational life cycle of chain 1024 and/or support rail 1020. In alternative embodiments, interface surface 1022 is defined in any suitable fashion that enables first rail member 1014 to function as described herein.

With reference to FIGS. 3 and 4, in the example embodiment, each chain 1024 defines a closed loop that circulates about support rail 1020 in a plane perpendicular to the transverse Y direction. In alternative embodiments, each chain 1024 is movable in longitudinal direction X in any suitable fashion that enables secondary container erecting section 1010 to function as described herein.

In the example embodiment, secondary container erecting section 1010 additionally includes an articulated chain cover 1025 secured to, and movable with, each respective chain 1024. Chain covers 1025 of each chain 1024 cooperate to define support surface 1027 on which secondary containers 200 are conveyed through secondary container erecting section 1010. In the example embodiment, chain cover 1025 includes a plurality of cover segments 1029, and each cover segment 1029 is coupled to a respective link 1028 of chain 1024, such that cover 1025 articulates with chain 1024 around curved portions of a path of chain 1024. Cover segments 1029 are shaped to cooperate to provide a substantially flat support surface 1027 along portions of the path of chain 1024 that define a straight line. In alternative embodiments, chain cover 1025 has any other suitable structure that enables chain cover 1025 to function as described herein. For example, in some embodiments, cover segments 1029 are formed integrally with chain links 1028. In other alternative embodiments, at least some chains 1024 of secondary container erecting section 1010 does not include chain cover 1025. For example, but not by way of limitation, secondary containers 200 are conveyed through secondary container erecting section 1010 while positioned directly on links 1028 of at least one chain 1024.

In the example embodiment, secondary container erecting section 1010 further includes a plurality of fingers 1021, rather than cover segments 1029, coupled to respective links 1028 of at least one chain 1024 at selected link intervals along chain 1024. The link interval is selected to correspond to a length of secondary container 200 along the longitudinal X direction, such that one secondary container 200 is receivable in a clearance fit between each pair of fingers 1021. Fingers 1021 facilitate maintaining a selected spacing of secondary containers 200 along rail members 1014 and 1016.

Moreover, in the example embodiment, fingers 1021 are selectively detachable and re-attachable to any link 1028 along the at least one chain 1024, such that fingers 1021 are repositionable to accommodate conveying secondary containers 200 of varying sizes by rail members 1014 and 1016. In alternative embodiments, fingers 1021 are other than selectively detachable and re-attachable to the at least one chain 1024.

It should be noted that, because secondary containers 200 are carried on moving chain 1024, rather than pushed along a stationary rail, fingers 1021 do not substantially contribute to pushing secondary containers 200 through secondary container erecting section 1010. In alternative embodiments, secondary container erecting section 1010 does not include fingers 1021.

Although a structure of second rail member 1016 is not described herein, it should be understood that second rail member 1016 has any suitable structure as described above for first rail member 1014. In the example embodiment, a distance between rail members 1014 and 1016, measured parallel to the transverse Y direction, is adjustable to provide a selected overall width of support surface 1027 that accommodates a width of secondary container 200. For example, first rail member 1014 is fixed with respect to frame 1002, and second rail member 1016 is coupled to frame 1002 for adjustment relative to frame 1002 in the transverse Y direction, such that second rail member 1016 is moveable in the Y direction to adjust the distance between rail members 1014 and 1016. In alternative embodiments, the distance between rail members 1014 and 1016 in the transverse Y direction is adjustable in any suitable fashion that enables secondary container erecting section 1010 to function as described herein. In other alternative embodiments, the distance between rail members 1014 and 1016 in the transverse Y direction is not adjustable.

In some embodiments, supporting secondary containers 200 on top of moving chains 1024 facilitates a reduced size of chains 1024, as compared to pushing secondary containers 200 along stationary rails by fingers attached to chains that are positioned inside of, or offset from, the stationary rails. As a result of the reduced size of the chains and/or the reduced need for positioning the chains within the rails, chains 1024 on rail members 1014 and 1016 can be placed closer together, facilitating secondary containers 200 having a smaller dimension in transverse direction Y. More specifically, the present disclosure facilitates placing a plurality of primary containers 600, such as but not limited to cans or bottles, into secondary container 200 in, for example, a 2×2, 2×4, or 2×6 array.

Figure 5:
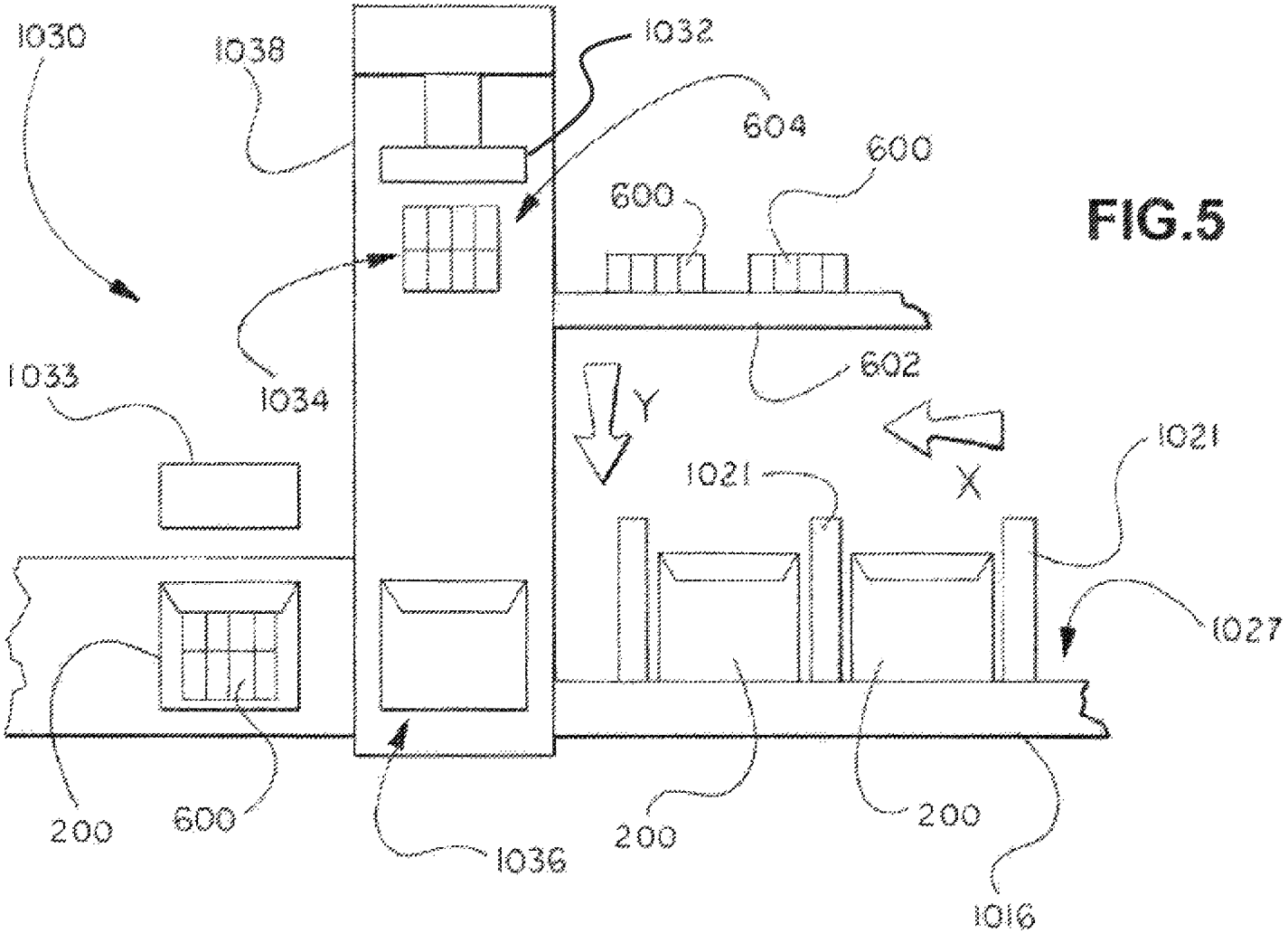
FIG. 5 is a schematic view of an example embodiment of a secondary container filling section of the machine shown in FIG. 3.

FIG. 5 is a schematic view of an example embodiment of secondary container filling section 1030. With reference to FIGS. 3 and 5, secondary container filling section 1030 is configured to position a selected number and arrangement of primary containers 600 within each secondary container 200, and in some embodiments, to complete formation of each filled secondary container 200 by forming at least one of end walls 224 and 226. In the example embodiment, primary containers 600 are conveyed to secondary container filling section 1030 via a suitable conveyor belt 602. In alternative embodiments, primary containers 600 are supplied to secondary container filling section 1030 in any suitable fashion that enables secondary container filling section 1030 to function as described herein.

In the example embodiment, secondary container filling section 1030 includes an alignment platform 1038. The plurality of primary containers 600, such as but not limited to cans or bottles, are conveyed to alignment platform 1038, and a selected arrangement 604 of primary containers 600 is positioned on a first portion 1034 of alignment platform 1038. Secondary container filling section 1030 includes any suitable mechanism, for example including sensors and actuators operatively coupled to controller 1001, to facilitate alignment of primary containers 600 in selected arrangement 604 on first portion 1034 of alignment platform 1038. Similarly, secondary containers 200 are conveyed to alignment platform 1038, and one secondary container 200 is positioned on a second portion 1036 of alignment platform 1038. Secondary container filling section 1030 includes any suitable mechanism, for example including sensors and actuators operatively coupled to controller 1001, to facilitate alignment of secondary container 200 in a selected orientation on second portion 1036 of alignment platform 1038. In certain embodiments, at least second portion 1036 of alignment platform 1038 is provided by rail members 1014 and 1016.

In the example embodiment, secondary container filling section 1030 also includes a pusher 1032 coupled to frame 1002. Pusher 1032 is operable to push primary containers 600 in transverse direction Y from first portion 1034 to second portion 1036 of alignment platform 1038, such that primary containers 600 are received through an open end of secondary container 200. For example, sensors (not shown) operatively coupled to controller 1001 detect that arrangement 604 of primary containers 600 is completed on first portion 1034 and that an unfilled secondary container 200 is oriented on second portion 1036, and controller 1001 activates pusher 1032. In alternative embodiments, secondary container filling section 1030 includes any suitable structure that enables positioning of a selected number and arrangement of primary containers 600 within each secondary container 200.

Further in the example embodiment, secondary container filling section 1030 includes a suitable second end flap folder/gluer assembly 1033 coupled to frame 1002 downstream from alignment platform 1038. In the example embodiment, second end flap folder/gluer assembly 1033 is operable to form the one of first and second end walls 224 and 226 of the filled secondary container 200 that was not formed previously, as described above. In alternative embodiments, neither of first and second end walls 224 and 226 is formed by machine 1000 prior to filling secondary container 200, and secondary container filling section 1030 includes a pair of folder/gluer assemblies (not shown) for forming both end walls 224 and 226. In other alternative embodiments, secondary container erecting section 1010 includes any suitable structure for forming one or both of first and second end walls 224 and 226 of secondary container 200 that enables machine 1000 to function as described herein.

Figure 6:
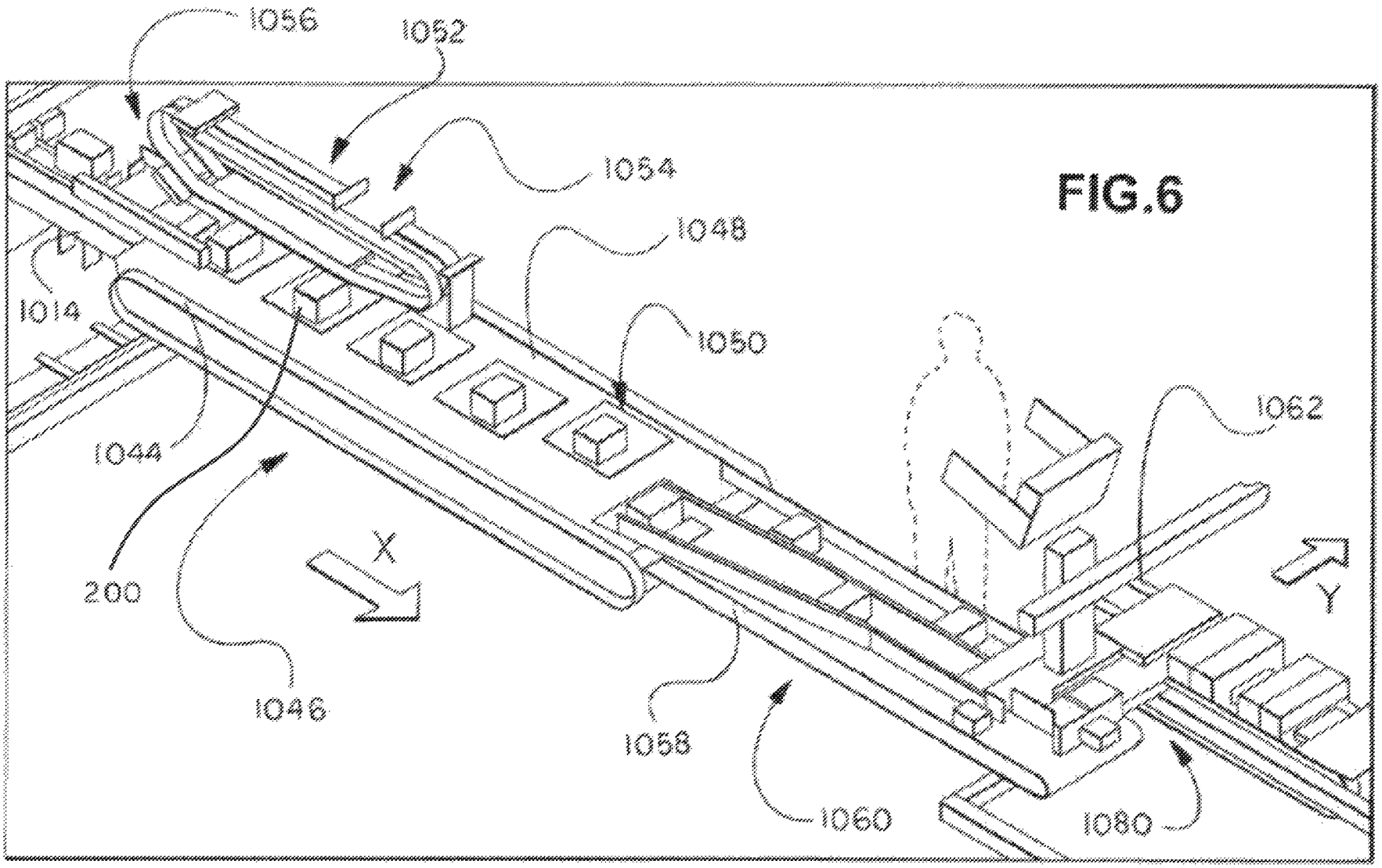
FIG. 6 is a schematic view of an example embodiment of a secondary container arranging section of the machine shown in FIG. 3.

FIG. 6 is a schematic view of an example embodiment of secondary container arranging section 1040. With reference to FIGS. 3 and 6, secondary container arranging section 1040 includes a routing mechanism 1046 coupled to frame 1002. Routing mechanism 1046 is operable to receive filled secondary containers 200 in a single file stream from rail members 1014 and 1016, and to selectively route the filled secondary containers 200 into a plurality of streams to facilitate arranging secondary containers 200 for placement in a tertiary container 900. For example, in the embodiment illustrated in FIG. 6, routing mechanism 1046 routes secondary containers 200 downstream in longitudinal direction X in two separate streams. In alternative embodiments, routing mechanism 1046 routes secondary containers 200 downstream into any suitable number of streams that enables machine 1000 to function as described herein.

In the example embodiment, a suitable container sensor 1044 coupled to frame 1002 and operatively coupled to controller 1001 registers an arrival of each secondary container 200 in the received single file stream. Based on the input received from container sensor 1044, controller 1001 selectively actuates routing mechanism 1046 to route each secondary container 200 into a selected stream of the plurality of streams. In alternative embodiments, routing mechanism 1046 is actuated to selectively route secondary containers 200 in any suitable fashion that enables secondary container arranging section 1040 to function as described herein.

In the example embodiment, routing mechanism 1046 is implemented as a conveyor belt 1048 that includes a plurality of selectively operable, bi-directional transverse rollers 1050 embedded in the conveying surface. More specifically, as conveyor belt 1048 moves each secondary container 200 downstream in the X direction, rollers 1050 in a portion of conveyor belt 1048 underneath selected secondary containers 200 are activated to simultaneously move the selected secondary containers 200 parallel to the transverse Y direction, such that the selected containers 200 are positioned in a selected stream of the plurality of streams as they reach a downstream end of conveyor belt 1048. For example, controller 1001 tracks an orientation of conveyor belt 1048 and, based on a timing of a signal from container sensor 1044, determines which rollers 1050 are underneath each secondary container 200 received on conveyor belt 1048. Controller 1001 then activates the bi-directional transverse rollers 1050 underneath selected containers 200 in accordance with a preselected streaming pattern. In alternative embodiments, routing mechanism 1046 includes any suitable structure that enables routing of the stream of received filled secondary containers 200 into a plurality of streams as described herein.

In some embodiments, routing mechanism 1046 also includes a container rotator mechanism 1052 coupled to frame 1002 that facilitates changing an orientation of selected secondary containers 200 for packaging purposes. More specifically, secondary containers 200 are received from rail members 1014 and 1016 in a first orientation, such as an orientation that facilitates placement of primary containers 600 within secondary containers 200, but it is desired to move filled secondary containers 200 into tertiary containers 900 in a second orientation that enables more efficient packing of tertiary containers 900. Moreover, container rotator mechanism 1052 facilitates accommodating different sizes and combinations of secondary containers 200 to be packed together in tertiary container 900.

In the example embodiment, container rotator mechanism 1052 is coupled to an upstream portion of routing mechanism 1046, such that container rotator mechanism 1052 is operable to re-orient secondary container 200 before activation, if any, of transverse rollers 1050 underneath secondary container 200. In alternative embodiments, container rotator mechanism 1052 is positioned at any suitable location that enables secondary container arranging section 1040 to function as described herein.

In the example embodiment, container rotator mechanism 1052 includes rotator belts 1056, and rotator grips 1054 coupled to belts 1056 at spaced intervals. Rotator belts 1056 are operable to move rotator grips 1054 in a closed loop path. In some embodiments, rotator belts 1056 and rotator grips 1054 are positioned for engaging secondary containers 200 by controller 1001, based on input received from container sensor 1044. Rotator grips 1054 are configured to "grip" the top of a selected secondary container 200 and rotate the secondary container 200 about an axis normal to the surface of conveyor belt 1048 by a selected angle. For example, in an embodiment, rotator grips 1054 are operable to rotate the selected secondary container 90 degrees.

In an alternative embodiment, container rotator mechanism 1052 is implemented as a bump wheel (not shown) positioned between conveyor belt 1048 and rail members 1014 and 1016. For example, the bump wheel is located proximate a transverse edge, with respect to the transverse Y direction, of conveyor belt 1048, and includes a relatively high-friction surface. As each secondary container 200 moves from rail members 1014 and 1016 to conveyor belt 1048, the bump wheel engages a corner of secondary container 200 and slows it down relative to the remainder of the container, causing secondary container 200 to rotate, for example, 90 degrees.

In alternative embodiments, container rotator mechanism 1052 includes any suitable structure that enables changing the orientation of secondary containers 200 as described herein.

In the example embodiment, secondary container arranging section 1040 includes a pre-loading conveyor 1060 coupled to frame 1002 downstream from routing mechanism 1046. Pre-loading conveyor 1060 is operable to receive the plurality of streams of secondary containers 200 from routing mechanism 1046 and convey the secondary containers 200 to tertiary container filling section 1080. In alternative embodiments, secondary container arranging section 1040 does not include pre-loading conveyor 1060. For example, routing mechanism 1046 delivers the plurality of streams of secondary containers 200 directly to tertiary container filling section 1080.

In certain embodiments, secondary container arranging section 1040 further includes alignment guides 1058 that facilitate maintaining an alignment of secondary containers 200 in the plurality of streams. In the example embodiment, alignment guides 1058 are coupled to pre-loading conveyor 1060. In alternative embodiments, alignment guides 1058 are coupled to any suitable portion of secondary container arranging section 1040. In an embodiment, alignment guides 1058 are detachable and re-attachable to pre-loading conveyor 1060 in different orientations. Different embodiments may include a different number and spacing of alignment guides 1058, corresponding to a size of containers 200 and the number of streams in the "packaging recipe" of the user, wherein a packaging recipe is a specific selected combination of secondary containers 200 within tertiary container 900. In alternative embodiments, secondary container arranging section 1040 does not include alignment guides 1058.

Figure 7:
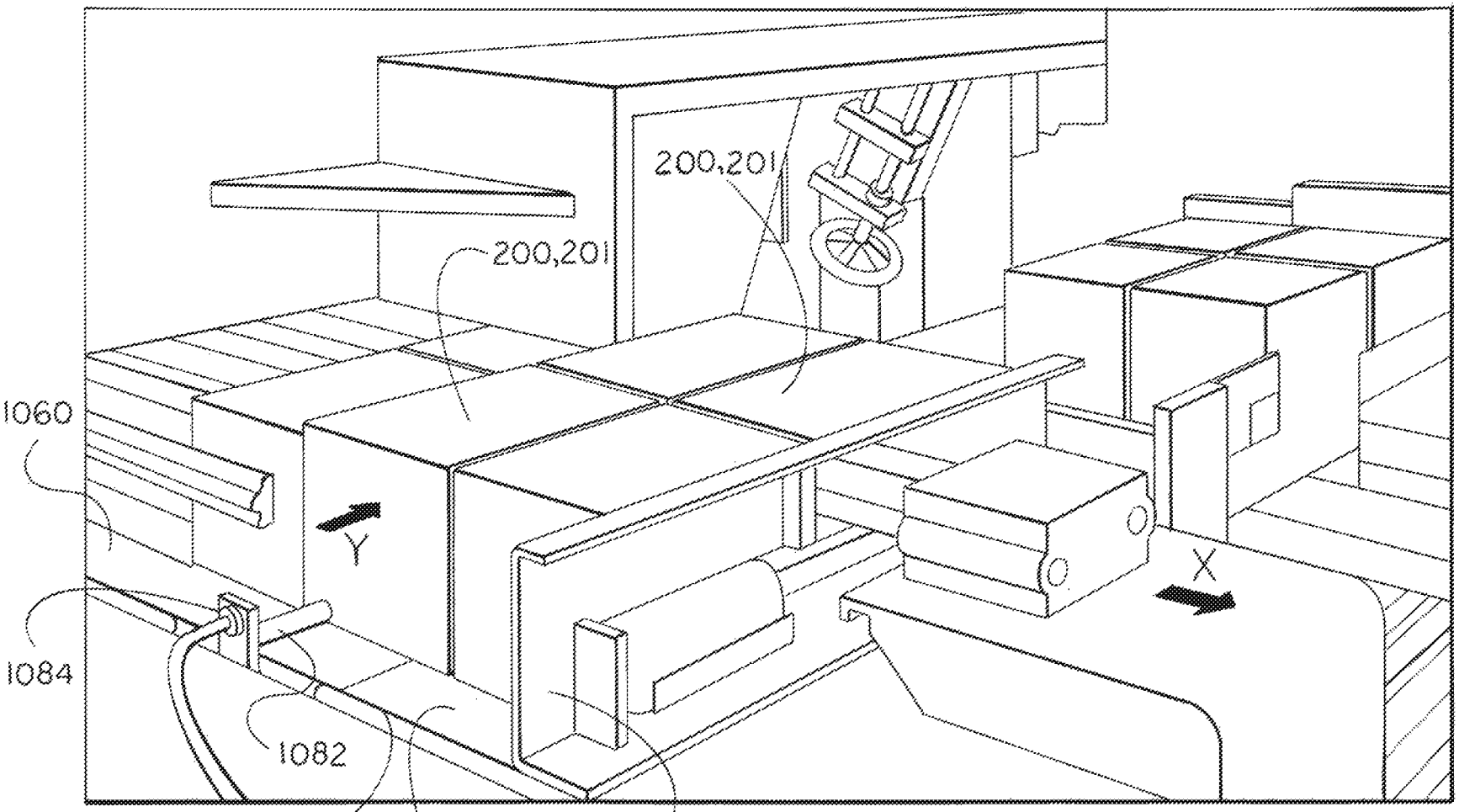
FIG. 7 is a schematic perspective view of an example embodiment of a tertiary container filling section of the machine shown in FIG. 3, showing a back stop in a first, upstream position and a front gate in a first, obstructing position.
Figure 8:
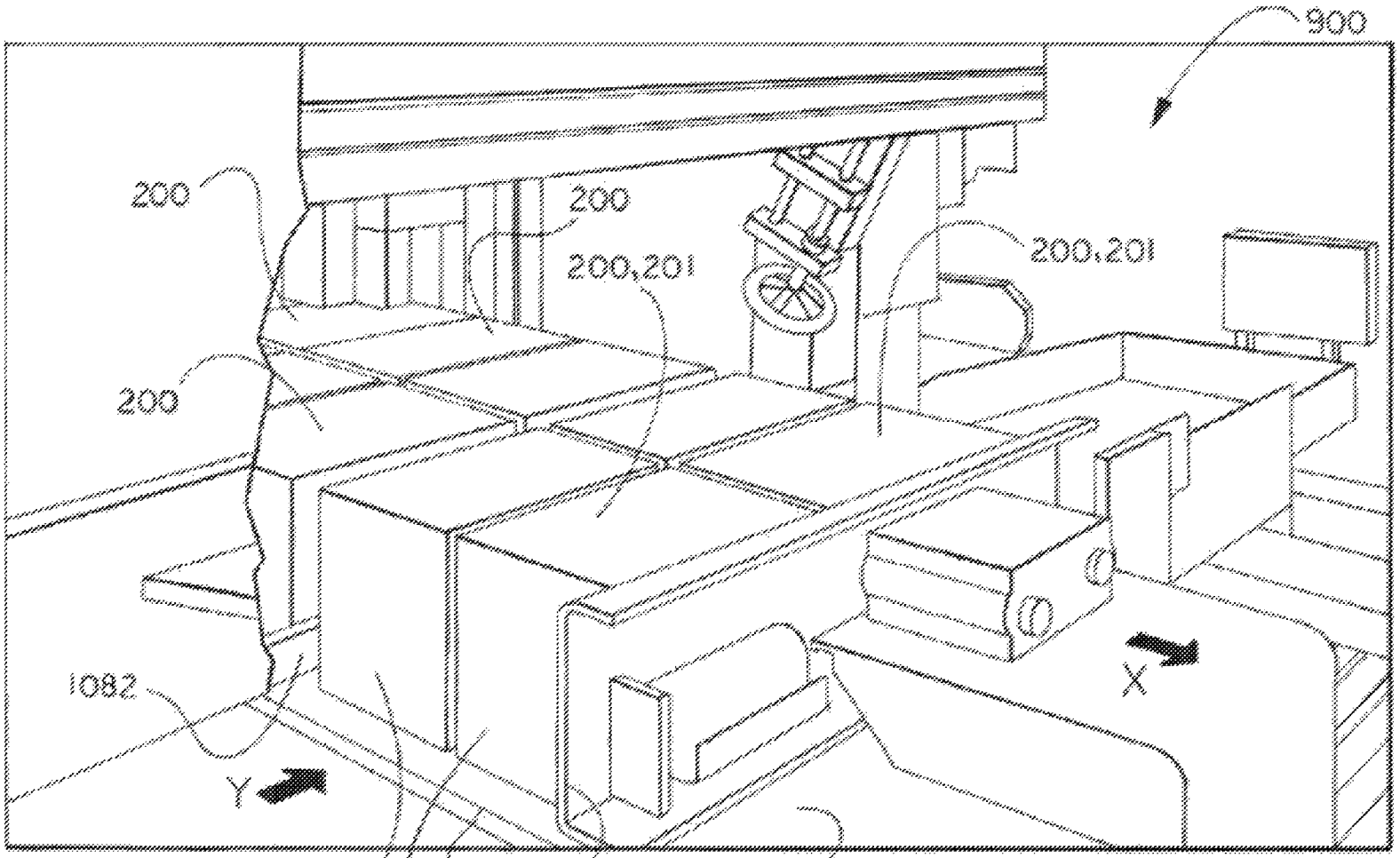
FIG. 8 is a schematic perspective view of the example tertiary container filling section shown in FIG. 7, showing the back stop in a second, downstream position and the front gate in the first, obstructing position.
Figure 9:
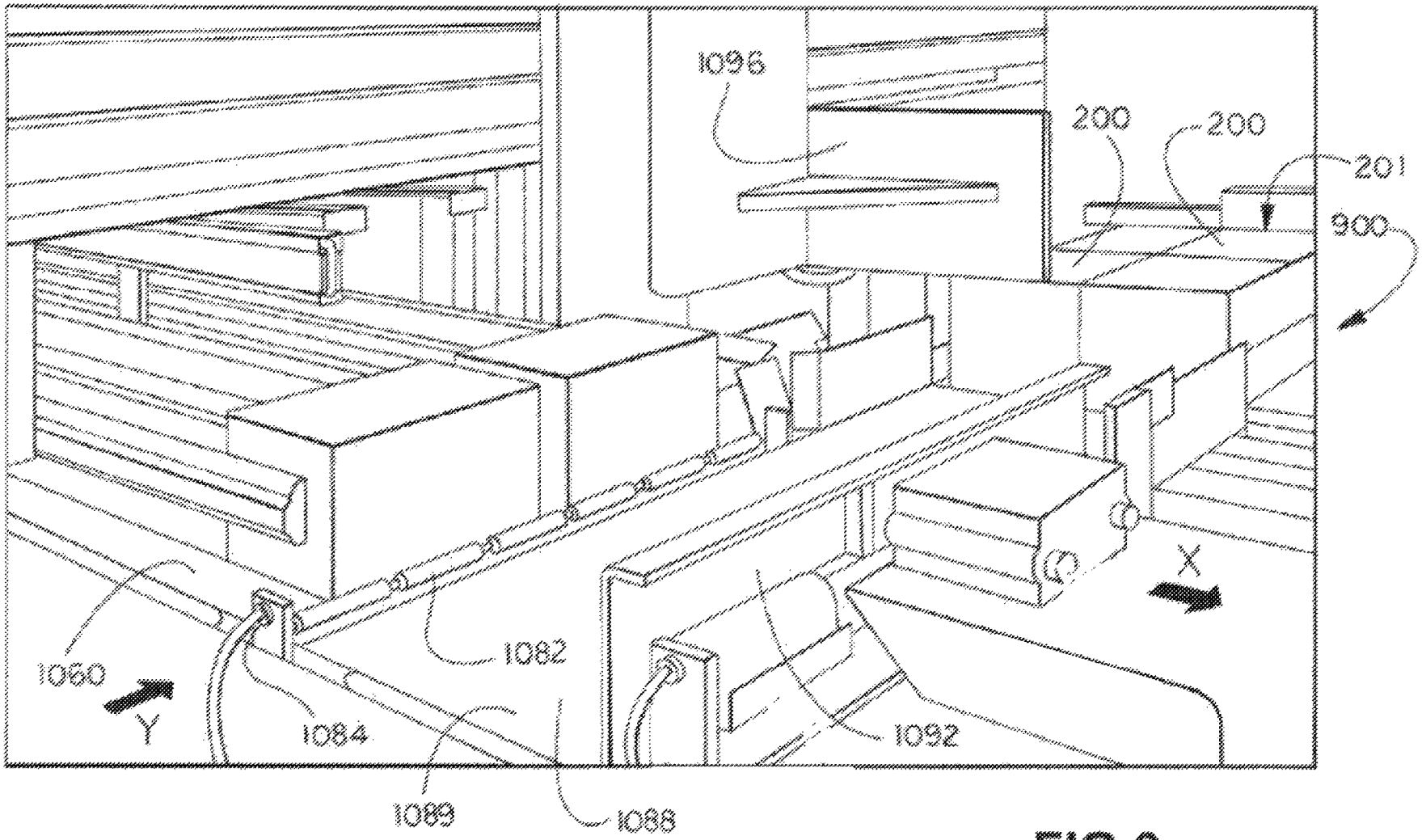
FIG. 9 is a schematic perspective view of the example tertiary container filling section shown in FIG. 7 after an arrangement of the secondary containers shown in FIG. 2 has been transferred to a tertiary container.

FIG. 7 is a schematic perspective view of an example embodiment of tertiary container filling section 1080 showing a back stop 1092 in a first, upstream position and a front gate 1082 in a first, obstructing position. FIG. 8 is a schematic perspective view of the example embodiment of tertiary container filling section 1080 showing back stop 1092 in a second, downstream position and front gate 1082 in the first, obstructing position. FIG. 9 is a schematic perspective view of the example embodiment of tertiary container filling section 1080 after an arrangement 201 of secondary containers 200 has been transferred to tertiary container 900.

With reference to FIGS. 3 and 7-9, tertiary container filling section 1080 is configured to receive secondary containers 200 from secondary container arranging section 1040, and to place secondary containers 200 in a selected arrangement 201 in tertiary container 900. In the example embodiment, tertiary container 900 is a corrugated shipping tray. Moreover, in the example embodiment, tertiary container filling section 1080 is operable to form tertiary container 900 from a blank of sheet material by folding end panels and side panels of the blank into orthogonal relationship with a bottom panel of the blank, and coupling together the end and side panels. For example, tertiary container filling section 1080 includes a suitable hopper, a suitable transfer mechanism, and a suitable conveyor, similar to as described above with respect to secondary container erecting section 1010, for positioning tertiary container 900 relative to tray loading station 1088. In alternative embodiments, tertiary container 900 is any suitable container formed in any suitable fashion from any suitable material.

Tertiary container filling section 1080 includes a tray loading station 1088 positioned to receive secondary containers 200 from the plurality of streams provided by secondary container arranging section 1040. For example, in the example embodiment, tray loading station 1088 receives two side-by-side streams of secondary containers 200 from pre-loading conveyor 1060, and tertiary container 900 is sized and oriented to receive secondary containers 200 in a two-wide arrangement 201. In alternative embodiments, tray loading station 1088 is sized to receive any suitable number of streams of secondary containers 200.

In the example embodiment, tray loading station 1088 includes a conveyor belt 1089 that receives secondary containers 200 from pre-loading conveyor 1060, and conveys received secondary containers 200 in the downstream X direction until stopped by back stop 1092. In addition, in the example embodiment, conveyor belt 1089 of tray loading station 1088 is operated at the same speed as pre-loading conveyor 1060. For example, tray loading station conveyor belt 1089 and pre-loading conveyor 1060 are driven simultaneously by the same motor. In alternative embodiments, tray loading station conveyor belt 1089 is operated at any suitable speed that enables tray loading station 1088 to function as described herein.

In alternative embodiments, tray loading station 1088 includes any suitable structure that enables tray loading station 1088 to function as described herein.

In the example embodiment, tertiary container filling section 1080 also includes front gate 1082 positioned at an upstream end of tray loading station 1088, and more specifically, between tray loading station conveyor belt 1089 and pre-loading conveyor 1060. Front gate 1082 is selectively moveable between a first position, in which secondary containers 200 are obstructed from passing downstream from pre-loading conveyor 1060 to tray loading station conveyor belt 1089, and a second position, in which secondary containers 200 are not obstructed from passing downstream from pre-loading conveyor 1060 to receiving tray loading station conveyor belt 1089. More specifically, in the example embodiment, front gate 1082 in the first position extends above a surface of tray loading station conveyor belt 1089 to obstruct passage of containers 200 from pre-loading conveyor 1060 to tray loading station conveyor belt 1089, and front gate 1082 in the second position is retracted below the surface of tray loading station conveyor belt 1089 to permit passage of containers 200 from pre-loading conveyor 1060 to tray loading station conveyor belt 1089. In certain embodiments, front gate 1082 includes rollers along a top edge of front gate 1082 to facilitate passage of secondary containers 200 over front gate 1082 in the second, retracted position.

In alternative embodiments, front gate 1082 has any suitable structure that enables front gate 1082 to function as described herein.

In the example embodiment, tertiary container filling section 1080 also includes back stop 1092 proximate a downstream end of tray loading station 1088. As described above, back stop 1092 is selectively moveable between the first, upstream position and the second, downstream position. When back stop 1092 is in the first, upstream position, tray loading station 1088 is sized such that when the first row of secondary containers 200 in arrangement 201 is positioned against back stop 1092, a portion of each of the secondary containers 200 in the last, most upstream row of arrangement 201 is positioned directly above front gate 1082. The second, downstream position of back stop 1092 is spaced from the first, upstream position such that tray loading station 1088 is sized to receive the entirety of back row of arrangement 201 downstream of front gate 1082.

To position secondary containers 200 in arrangement 201 on tray loading station 1088, front gate 1082 is initially positioned in the second position, such that the plurality of streams of secondary containers 200 are delivered adjacent, and upstream from, front gate 1082 on pre-loading conveyor 1060. Moreover, back stop 1092 is initially positioned in the first, upstream position. After sufficient secondary containers 200 are received on pre-loading conveyor 1060 adjacent front gate 1082 to form arrangement 201, front gate 1082 is retracted to the second, or unobstructing, position, such that pre-loading conveyor 1060 and tray loading station conveyor belt 1089 cooperate to move arrangement 201 downstream until the first row of secondary containers 200 engages back stop 1092. As described above, because back stop 1092 is in the first position, a portion of each of the secondary containers 200 in the last, most upstream row of arrangement 201 is positioned directly above retracted front gate 1082. After secondary containers 200 are positioned against back stop 1092, front gate 1082 is extended to the first position, such that front gate 1082 engages secondary containers 200 in the back row and partially elevates the back row above a surface of tray loading station 1088. For example, in the illustration of FIG. 7, arrangement 201 includes two rows of secondary containers 200 in a two-wide array, the first row is positioned against back stop 1092 in the first, upstream position, and the back row is positioned directly above, and elevated partially above tray loading station 1088 by, front gate 1082 in the first, extended position. In certain embodiments, operation of tray loading station 1088 does not require a precise positioning of the last row of secondary containers 200 in arrangement 201 at this stage, but instead only requires that a portion of the last row be downstream of front gate 1082. Therefore, indexed back stop 1092 facilitates a greater tolerance in a timing of operation of front gate 1082.

Next, in the example embodiment, back stop 1092 is moved from the first position to the second, downstream position. Tray loading station conveyor belt 1089 immediately conveys secondary containers 200 downstream until the first row of arrangement 201 again contacts back stop 1092. As described above, the second position is spaced from the first, upstream position such that tray loading station 1088 is sized to receive the entirety of the back row of arrangement 201 downstream of front gate 1082. Moreover, although pre-loading conveyor 1060 continues to convey succeeding secondary containers 200 downstream in the X direction, any additional upstream secondary containers 200 are prevented from reaching tray loading station 1088 by the extended front gate 1082, as shown in FIG. 8.

Further in the example embodiment, tertiary container filling section 1080 positions tray 900 in transverse alignment with arrangement 201, as formed on tray loading station 1088 adjacent back stop 1092 in the downstream position. A pusher 1096 sweeps across tray loading station 1088 in the transverse Y direction, moving arrangement 201 of secondary containers 200 from tray loading station conveyor belt 1089 through an open end of tertiary container 900 to be received by tertiary container 900, as shown in FIG. 9. The open end panel of tertiary container 900 is then closed to complete formation of tertiary container 900, and tertiary container 900 is conveyed out of tertiary container filling section 1080 in any suitable fashion. Back stop 1092 is returned to the first, upstream position and the process is repeated as soon as sufficient secondary containers 200 arrive to form another arrangement 201 on pre-loading conveyor 1060 adjacent front gate 1082.

In the example embodiment, an elevation of pusher 1096 above tray loading station 1088 is increased as pusher 1096 is returned to its starting position opposite the transverse Y direction. Thus, the return path of pusher 1096 does not interfere with the receipt of a new arrangement 201 of secondary containers 200 on tray loading station 1088, enabling an increased speed in the transfer of arrangement 201 from pre-loading conveyor 1060 to tray loading station 1088. In alternative embodiments, pusher 1096 is returned to its starting position in any suitable fashion.

As described above, the cooperation of front gate 1082 and back stop 1092 facilitate operating each of pre-loading conveyor 1060 and tray loading station conveyor belt 1089 in continuous fashion. More specifically, the cooperation of front gate 1082 and back stop 1092 reduces a time during which secondary containers 200 are not moving downstream towards tray loading station 1088, thereby reducing a time required for the packaging process as a whole. In addition, the cooperation of front gate 1082 and back stop 1092 enables on-demand loading of each tertiary container 900, without any need to accumulate and re-separate excess secondary containers 200, thereby decreasing an expense, weight, and footprint size of machine 1000 relative to known machines.

In certain embodiments, at least one sensor 1084 is positioned relative to tray loading station 1088 and operatively coupled to controller 1001. For example, the at least one sensor 1084 includes at least one container detector that detects when secondary containers 200 are present in, or move past, a selected location. Moreover, in certain embodiments, each of front gate 1082, back stop 1092, and pusher 1096 is operatively coupled to controller 1001, such that controller 1001 is operable to automatically control, for example, at least one of an activation/deactivation timing, a speed of movement, and a direction of movement of each of front gate 1082, back stop 1092, and pusher 1096 based on at least one of a feedback signal from the at least one sensor 1084 and a set of pre-programmed instructions. For example, but not by way of limitation, the at least one sensor 1084 includes a sensor operable to detect when sufficient containers 200 have arrived to form arrangement 201 on pre-loading conveyor 1060 adjacent front gate 1082, and/or a sensor operable to detect when containers 200 are received against back stop 1092. In certain embodiments, a use of controller 1001 increases a speed and/or accuracy of operation of tertiary container filling section 1080. In alternative embodiments, machine 1000 does not include sensor 1084 and/or computer-implemented controller 1001.

In some embodiments, machine 1000 is configured to assemble containers of any suitable size and any suitable shape without limitation. Therefore, to accommodate assembly of such a large variety of containers, controller 1001 is operatively coupled to sensors that are configured to automatically detect dimensional features of KDF blank 100, secondary container 200, and/or tertiary container 900 of varying shapes and sizes, including, but not limited to, length, width, and/or depth.

Exemplary embodiments of a machine and method for forming a secondary container, filling the secondary container with an arrangement of primary containers, and packaging the secondary containers in a tertiary container, such as for shipping, are described above. The methods and machine are not limited to the specific embodiments described herein, but rather, components of systems and/or steps of the methods may be utilized independently and separately from other components and/or steps described herein. For example, the machine may also be used in combination with other blanks and containers, and is not limited to practice with only the blank and container described herein.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to illustrate the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A machine for filling a tertiary container with a plurality of secondary containers, said machine comprising:

a frame;

a tray loading station coupled to the frame and positioned to receive a plurality of separate streams of the secondary containers from an upstream direction into the tray loading station in a downstream direction, to form a two-dimensional arrangement of secondary containers at the tray loading station;

a front gate positioned at an upstream end of the tray loading station, the front gate selectively moveable between a first position, in which the secondary containers are obstructed from passing downstream to the tray loading station, and a second position, in which the secondary containers are not obstructed from passing downstream to the tray loading station;

a back stop proximate a downstream end of the tray loading station, the back stop selectively translatable parallel to the downstream direction between a first, upstream position and a second, downstream position, wherein the tray loading station is sized such that when a first row of secondary containers is positioned against the back stop positioned in the first position, a portion of an upstream row of secondary containers is positioned directly above the front gate; and a pusher configured to push the two-dimensional arrangement of secondary containers in a transverse direction, transverse to the downstream direction, from the tray loading station into the tertiary container.

2. The machine of claim 1, further comprising a secondary container filling station upstream of the tray loading station, at which each of the secondary containers are filled with a respective plurality of primary containers.

3. The machine of claim 2, further comprising a secondary container erecting station upstream of the secondary container filling station, at which each of the secondary containers is erected from a respective knocked-down-flat blank.

4. The machine of claim 2, further comprising a secondary container arranging station downstream of the secondary container filling station, the secondary container arranging station comprising a routing mechanism configured to receive the secondary containers in a single stream from the secondary container filling station and selectively route the secondary containers into the plurality of separate streams.

5. The machine of claim 1, further comprising a pre-loading conveyor upstream of the tray loading station and configured to convey the secondary containers to the tray loading station, wherein the front gate is positioned between a downstream end of the pre-loading conveyor and the upstream end of the tray loading station.

6. The machine of claim 1, wherein, in the first position, the front gate extends above a surface of the tray loading station.

7. The machine of claim 6, wherein, in the second position, the front gate is retracted below the surface of the tray loading station.

8. The machine of claim 1, wherein the front gate includes one or more rollers along a top edge thereof.

9. The machine of claim 1, wherein the tray loading station comprises a conveyor belt configured to transfer the first row and the upstream row of secondary containers in a downstream direction after the back stop is translated in the downstream direction from the first position to the second position.

10. The machine of claim 9, wherein the conveyor belt transfers the first row and the upstream row of secondary containers in the downstream direction until the first row of secondary containers contacts the back stop in the second position.

11. The machine of claim 9, wherein the conveyor belt transfers the first row and the upstream row of secondary containers in the downstream direction until an entirety of the upstream row of secondary containers is downstream of the front gate.

12. The machine of claim 1, wherein an elevation of the pusher changes as the pusher moves along the transverse direction.

* * * * *